United States Patent [19]

Rothe et al.

[11] 4,049,409

[45] Sept. 20, 1977

[54] METHOD FOR TRANSFERRING A HIGHLY COMPRESSED GAS FROM A REACTOR TO A STORAGE TANK WITH CONDENSATION OF THE GAS

[75] Inventors: Rudolf Rothe, Bremen; Johann Kohler, Barrien, both of Germany

[73] Assignee: HAG Aktiengesellschaft, Bremen, Germany

[21] Appl. No.: 664,886

[22] Filed: Mar. 8, 1976

[30] Foreign Application Priority Data

Mar. 25, 1975 Germany ..... 2513169

[51] Int. Cl.[2] ..... F25T 1/00; F17C 7/02

[52] U.S. Cl. ..... 62/9; 62/55

[58] Field of Search ..... 62/9, 45, 55, 23, 27, 62/28, 36; 137/317

[56] References Cited

FOREIGN PATENT DOCUMENTS

| | | | |
|---|---|---|---|
| 874,245 | 6/1971 | Canada | 62/9 |
| 1,960,515 | 12/1969 | Germany | 62/9 |
| 404,604 | 7/1961 | Japan | 62/45 |

*Primary Examiner*—Hiram H. Bernstein

*Attorney, Agent, or Firm*—Watson, Leavenworth, Kelton & Taggart

[57] ABSTRACT

A method for transferring a highly compressed gas from a reactor into a storage tank with condensation of the gas is disclosed in which the gas is at first liquefied and cooled to a temperature below the storage temperature, then the liquefied gas is expanded and transferred into the storage tank, and after the pressure in the reactor has dropped to about the pressure in the storage tank, the remaining gas in the reactor is transferred by a compressor from the reactor into the storage tank.

4 Claims, 1 Drawing Figure

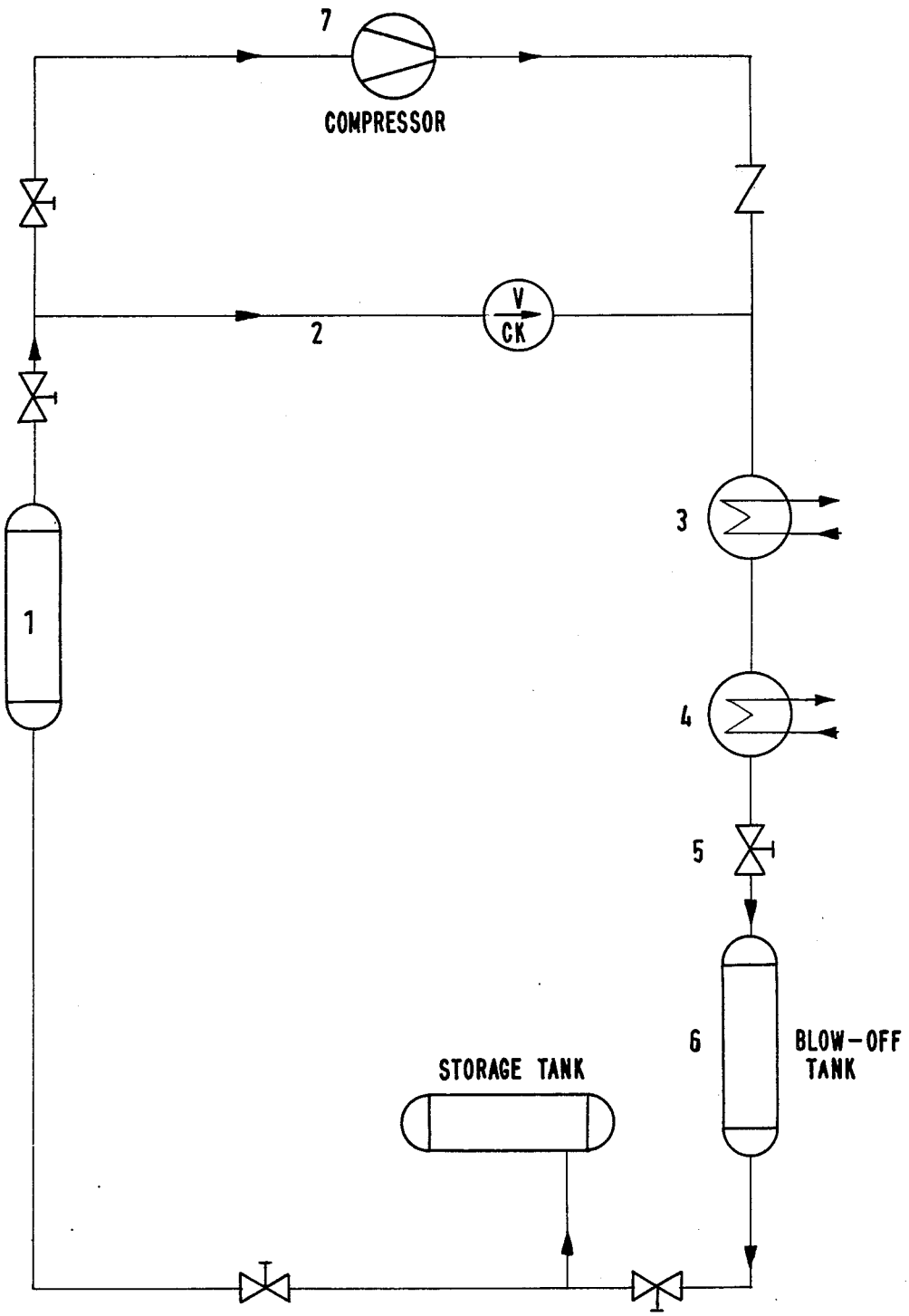
7
COMPRESSOR
V
CK
2
3
1
4
5
6
BLOW-OFF
TANK
STORAGE TANK

METHOD FOR TRANSFERRING A HIGHLY COMPRESSED GAS FROM A REACTOR TO A STORAGE TANK WITH CONDENSATION OF THE GAS

BACKGROUND OF THE INVENTION

1. Field of the Invention

This invention relates to the field of methods for transferring highly compressed gas from a reactor to a storage tank accompanied by condensation of the gas.

2. Description of the Prior Art

In known and conventional practice, a reactor is evacuated by expanding the gas first to a low pressure, generally the evacuation pressure, and then compresssing the gas to the storage pressure, cooling the gas and finally, liquefying the gas. The gas is thus stored in the liquid state. Since the gas is only cooled after the compression step in the aforesaid procedure, the heat exchangers required for cooling the gas only have to be designed for the low storage pressure, and not for the higher pressure in the reactor. In known and conventional methods of this sort, the compressor required for evacuating the reactor and for filling the storage tank is likewise designed for the constant storage pressure.

Depending on the gas used and on its temperature and pressure in the reactor, this method can be improved in a known manner by the installation of an expansion turbine with a compressor running on the same axle. But this possibility exists only within a certain limited range of thermodynamic variables of state.

SUMMARY OF THE INVENTION

The problem of transferring a highly compressed gas from a reactor into a storage tank and to store it there in liquid form is solved according to the instant invention by first liquefying and cooling the gas to a temperature below the storage temperature.

The liquefied gas expands and is transferred into the storage tank, and, after the pressure in the reactor has dropped to the pressure in the storage tank, the remaining gas is transferred by a compressor from the reactor into the storage tank.

DESCRIPTION OF THE PREFERRED EMBODIMENTS

After the gas has been liquefied in accordance with the method of this invention, it is preferably conducted into a non-insulated blow-off tank whose temperature and pressure are lower than the temperature and pressure in the storage tank, and after the pressure in the reactor has dropped to about the pressure in the storage tank, the saturation pressure at the temperature below the storage temperature to which the gas is cooled, the remaining gas in the reactor is transferred by a compressor from the reactor into the blow-off tank and after the reactor is evacuated, the pressure of the liquefied gas in the non-insulated blow-off tank is increased by heat supply from the environment or by a heater to the pressure of the following storage tank and the gas is transferred from the blow-off tank to the storage tank. Due to the heating of the liquefied gas in the blow-off tank, the liquefied gas can be transferred to the storage tank without the use of a booster pump.

A preferred method, where $CO_2$ is used as an extracting agent, consists in cooling the $CO_2$, which can be used at a temperature of about 50° to 95° C. and a pressure of about 100 to 315 bar in the reactor, first to a temperature of about 5° C. and then expanding it to a pressure of 40 bar, after which it is stored at room temperature at a pressure of about 70 bar.

By cooling the gas to a temperature below the storage temperature, the reactor is evacuated substantially spontaneously, that is, without the interposition of a compressor. For transferring the remaining gas from the reactor into the storage tank, a compressor with a lower power than for cooling the gas to the storage temperature suffices. Preferably the condensation temperature directly above the freezing point of water is maintained, because the optimum working range insofar as capital investment, operating costs and safety are concerned is at this temperature.

It was found in practice that the advantage of using a compressor with a lower power is greater than the disadvantage of the necessity of using heat exchangers designed for a higher pressure, and of cooling the gas to a lower temperature.

The accompanying drawing is a diagrammatic illustration of a method according to the invention, wherein the transfer of a gas from a reactor 1 into a storage tank was selected as an example. During the evacuation of the reactor, the gas is conducted through line 2 to one or several heat exchangers 3, 4 in which it is cooled to a temperature below the storage temperature. From the heat exchangers the gas is conducted through a valve 5 into the blow-off tank 6.

Due to the cooling of the gas to a temperature below the storage temperature, the reactor is evacuated substantially spontaneously, but a residue of gas remains in the reactor which is the smaller the greater the gas is cooled in the heat exchanger. The gas residue in the reactor is exhausted by means of compressor 7 and is forced over heat exchangers 3, 4 and valve 5 into the blow-off tank 6. Since the gas in the blow-off tank has at first a temperature below the final storge temperature, the compressor only has to overcome a relatively small pressure difference, so that a compressor with a comparatively low power and a small number of stages can be used.

The cooling agent is supplied to the heat exchangers 3, 4 from a coolant reservoir. Since the heat exchangers are only operated intermittently according to the method of the invention, the interposition of a coolant reservoir permits the use of a refrigerating machine with a constant and lower power than if the heat exchanger were directly connected to a refrigerating machine, that is, without the interposition of a coolant reservoir.

The liquid gas can be pumped from the blow-off tank 6 by a booster pump into the storage tank, but the liquefied gas can also be transferred into the storage tank in this way that the pressure of the liquefied gas in the non-insulated expansion tank is increased by means of heat supply from the environment or by means of a heater to the pressure of the following storage tank, so that no booster pump is required.

The following examples are illustrative of the method of this invention:

EXAMPLE 1

In a method working with $CO_2$ the pressure in the reactor is about 160 bar at a temperature of about 66° C. When the reactor is evacuated, the gas is cooled in a first heat exchanger 3° to 35° C., and in a second heat exchanger 4° to 5° C. The liquefied $CO_2$ is conducted over valve 5 into blow-off tank 6 of the drawing. In this way, the reactor is evacuated until the pressure difference in the storage tank and in the reactor is equalized, and the pressure is about 40 bar. The further evacuation of the reactor to a pressure of 1 bar is effected by means of compressor 7.

EXAMPLE 2

In a method working with $N_2o$, pressure in the reactor is about 240 bar at a temperature of about 83° C. When the reactor is evacuated, the gas is cooled in a first heat exchanger 3° to 35° C., and in a second heat exchanger 4° to 5° C. The liquefied $N_2O$ is conducted over valve 5 into blow-off tank 6. In this way, the reactor is evacuated until the pressure difference in the storage tank and in the reactor has been equalized, the pressure being then about 37 bar. The further evacuation to a pressure of 1 bar is effected by means of compressor 7. The liquefied $N_2O$ can be transferred from blow-off tank 6 in the above described manner into the storage tank.

The following table contains the operating temperature and the operating pressure, as well as the cooling temperature to which a given gas is cooled by the heat exchangers, and the storage pressure for various gases.

| Gas | Operating Temp. ° C | Operating pressure (bar) | Cooling Temp. ° C | Storage pressure (bar) |
|---|---|---|---|---|
| $CO_2$ | 50–95 | 100–325 | 3–12 | 65–70 |
| $N_2O$ | 40–95 | 90–400 | 3–12 | 60–72 |
| $C_2H_6$ | 50–95 | 70–325 | 3–12 | 40–45 |
| $C_2H_4$ | 30–95 | 60–325 | 3–12 | 45–50 |
| $CH_3F$ | 60–95 | 60–325 | 3–12 | 50–57 |
| $CF_3Cl$ | 40–95 | 50–325 | 3–12 | 30–38 |

What is claimed is:

1. A method for transferring a highly compressed gas from a reactor into a storage tank with condensation of the gas which comprises at first liquefying and cooling the gas to a temperature below the storage temperature; expanding the liquefied gas in a blow-off tank; transferring the expanded liquefied gas into the storage tank; and after the pressure in the reactor has dropped to about the pressure in the storage tank exhausting any gas remainder portion in the reactor with a compressor and subjecting same to liquefying and cooling with subsequent expansion of said remainder portion in said blow-off tank; and transferring said expanded liquefied gas remainder portion to said storage tank.

2. The method according to claim 1, wherein the blow-off tank is a non-insulated vessel in which the temperature and pressure are lower than the temperature and pressure in the storage tank, and the pressure of the liquefied gas in the blow-off tank is increased by heating same to the pressure of the storage tank for transferring the liquefied gas from the blow-off tank into the storage tank.

3. The method according to claim 1 wherein the gas is $CO_2$ and in the reactor is at a temperature of 50° to 90° C. and a pressure of 100 to 315 bar, the $CO_2$ being cooled in the liquefying operation to a temperature of about 5° C., expanded in the blow-off tank to a pressure of about 40 bar, and subsequently stored in the storage tank at room temperature and a pressure of about 70 bar.

4. The method according to claim 1 wherein the gas is selected from the group consisting of $CO_2$, $N_2O$, $C_2H_6$, $C_2H_4$, $CH_3F$, and $CF_3Cl$ and mixtures thereof.

* * * * *